United States Patent [19]

Enoguchi et al.

[11] Patent Number: 4,486,014

[45] Date of Patent: Dec. 4, 1984

[54] APPARATUS FOR DISCHARGING SHEETS OF PAPER

[75] Inventors: Yuji Enoguchi, Osaka; Mikio Masui, Hyogo, both of Japan

[73] Assignee: Minolta Camera Kabushiki Kaisha, Osaka, Japan

[21] Appl. No.: 384,756

[22] Filed: Jun. 3, 1982

[30] Foreign Application Priority Data

Jun. 22, 1981 [JP] Japan ..... 56-96992

[51] Int. Cl.[3] ..... B65H 29/50

[52] U.S. Cl. ..... 271/200; 271/251; 271/272

[58] Field of Search ..... 271/251, 272, 302, 200, 271/314, 198; 414/54; 198/437

[56] References Cited

U.S. PATENT DOCUMENTS

| | | | |
|---|---|---|---|
| 3,241,651 | 3/1966 | Colby | 198/437 |
| 3,980,296 | 9/1976 | Craft | 271/251 |
| 3,994,487 | 11/1976 | Wicklund | 271/314 |
| 4,188,025 | 2/1980 | Gusfafson | 414/54 X |
| 4,208,122 | 6/1980 | Iwamoto | 355/14 R |

*Primary Examiner*—Richard A. Schacher

*Attorney, Agent, or Firm*—Wenderoth, Lind & Ponack

[57] ABSTRACT

An apparatus for discharging sheets of paper from a copying machine, printing machine, or the like. The apparatus has a plurality of spaced parallel belt supporting rollers with a belt member reeved around them and having at least one run extending from a first to a second one of the belt supporting rollers. The belt member is positioned to receive sheets on the outer peripheral surface at the end of the run adjacent the first belt supporting roller. An offset roller is positioned in rolling contact with the outer peripheral surface of the belt member at a position downstream of the first belt supporting roller and a solenoid or spring device is connected to the offset roller for changing the position of the offset roller between a position in which the axis of rotation thereof is parallel to the axis of rotation of the belt supporting rollers and a position in which the axis of rotation thereof is skew to the axis of rotation of the belt supporting rollers. A guide is positioned just downstream of the offset roller for guiding sheets of paper away from the belt member.

5 Claims, 9 Drawing Figures

APPARATUS FOR DISCHARGING SHEETS OF PAPER

BACKGROUND OF THE INVENTION

1. Field of the Invention

The present invention relates to a paper discharging apparatus for use in copying machines, printing machines, and the like for changing the direction of discharge of processed sheets as desired.

2. Description of the Prior Art

To discharge copy carrying or printed sheets from copying or printing machines and sorting the discharged sheets without using a large and expensive apparatus such as a sorter or collator, apparatus has been proposed in which a paper tray is movable sidewise for receiving the sheets thereon in different positions, as disclosed, for example, in U.S. Pat. No. 4,208,122 to Iwamoto et al., June 17, 1980. However, the apparatus of this type has the drawback of being hazardous to the user because the driven tray is external of the housing of the machine. Further when the tray is adapted to accommodate a large number of sheets, for example about 1000 sheets, delivered thereto, the apparatus requires a large mechanism for moving the tray and is therefore cumbersome.

Apparatus is also known which is adapted to carry out a simplified method of sorting without necessitating the movement of such a tray and in which the sheets being discharged are slidingly moved laterally in opposite directions within the machine and are thereafter delivered onto a fixed tray at different positions thereon. Apparatus of this type is disclosed in U.S. Pat. No. 3,980,296 to Craft et al., Sept. 14, 1976. This apparatus nevertheless has the drawback that the passage for the sheet within the machine must have a width sufficient for displacing the sheet laterally in opposite directions, which greatly increases the size of the machine. Furthermore, since the sheet is slidingly displaced laterally of the passage, there is an increased likelihood of trouble in the operation of the apparatus, such as wrinkling of sheets and jams. Thus such machines are not very trouble free.

OBJECT AND BRIEF SUMMARY OF THE INVENTION

The object of the present invention is to provide an apparatus for discharging sheets of paper onto a tray while sorting which overcomes the foregoing drawbacks and which does not result in any hazard during operation and also without the necessity of sliding the sheet laterally of the passage for the sheet.

This object is achieved according to the invention by providing an apparatus for discharging sheets of paper from a device for performing an operation on the sheets, said apparatus comprising:

a plurality of spaced parallel belt supporting rollers, one of said rollers being a drive roller;

a belt member reeved around said belt supporting rollers and having at least one run extending from a first to a second one of said belt supporting rollers, said belt member being positioned to receive sheets on the outer peripheral surface of said belt member at the end of said run adjacent said first belt supporting roller;

an offset roller in rolling contact with said outer peripheral surface of said belt member at a position downstream of said first belt supporting roller;

means connected to said offset roller for changing the position of the offset roller between a position in which the axis of rotation thereof is parallel to the axis of rotation of said first and second belt supporting rollers and a position in which the axis of rotation thereof is skew to the axis of rotation of said first and second belt supporting rollers; and guide means just downstream of said offset roller for guiding sheets of paper away from said belt member.

BRIEF DESCRIPTION OF THE DRAWINGS

The invention will become clear from the following specification together with the accompanying drawings, in which.

DETAILED DESCRIPTION OF THE INVENTION

Figure 1:
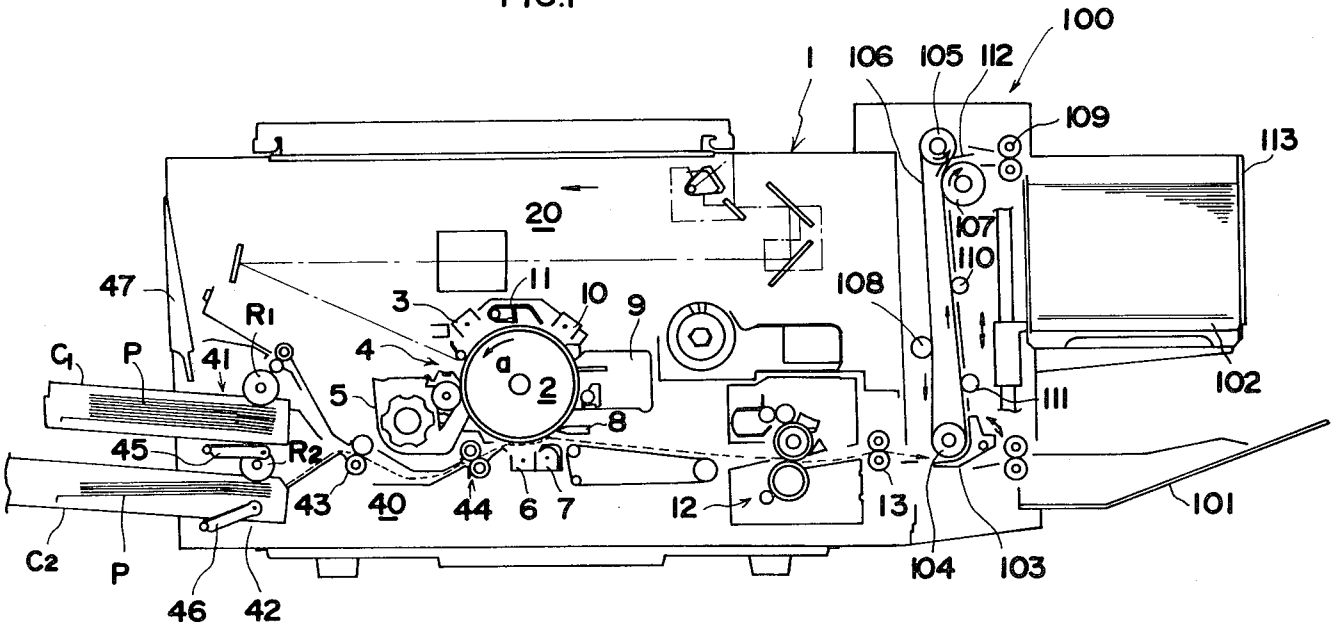
FIG. 1 is a schematic sectional view of a paper discharging apparatus embodying the invention and used with a copying machine.

FIG. 1 shows schematically the construction of an electronic copying machine 1 provided with a paper discharging apparatus 100 according to the invention. The construction and operation of the copying machine 1 will be described first with reference to this drawing.

A photoconductive drum 2 disposed approximately in the center of the main body of the machine 1 is rotatable in the direction of arrow a. Arranged around the drum 2 are a sensitizing charger 3, an exposure slit portion 4, a developing unit 5, a transfer charger 6, an erasing a.c. charger 7, a separating pawl 8, a cleaner 9, a pre-sensitizing charger 10 and an erasing lamp 11. During the rotation of the drum 2, the surface of the drum is charged by the charger 10 after being cleaned. The erasing lamp 11 removes the charge from the surface, which is then charged again by the sensitizing charger 3. The image of an unillustrated original is scanned by a document scanning system 20 and continuously projected through the exposure slit portion 4 onto the photoconductive surface to form a latent electrostatic image thereon. The latent image is developed by the developing unit 5 into a toner image, which is then transferred from the drum 2 to a sheet of paper P fed to the drum in timed relation with the above operation by a control unit. The sheet P is thereafter separated from the drum surface by the erasing a.c. charger 7 and the pawl 8 and fed to a fixing unit 12, in which the toner image is fixed to the sheet by heating. The sheet P is then sent to the discharging apparatus 100. On the other hand, the toner remaining on the surface of the drum 2 after the transfer is scraped off by the cleaner 9. The above-mentioned pre-sensitizing step thereafter follows again.

A paper transport-feed system 40 for sheets of paper P comprises upper and lower cassette loading portions 41 and 42 in the machine main body, paper feed rollers R1 and R2 provided at fixed positions above the corresponding loading portions, intermediate rollers 43, timing rollers 44, etc. Cassettes C1 and C2 are loaded into the upper and lower portions 41 and 42, the stacks of sheets P placed in the cassettes C1 and C2 are pressed against the feed rollers R1 and R2 by lift members 45 and 46. One of the feed rollers R1 and R2 is selectively driven to send a sheet of paper P into the machine.

The sheet P discharged from the cassette C1 or C2 comes into contact with the intermediate rollers 43 and is temporarily prevented from advancing. The rollers 43 rotate with suitable timing to forward the sheet P to the timing rollers 44, whereby the sheet is again restrained from advancing. The timing rollers 44 are driven in timed relation with the movement of the toner image formed on the drum 2 to feed the sheet to the transfer station.

The sheet P is subjected to the foregoing copying process and sent forward by delivery rollers 13 and selectively discharged into a lower tray 101 or an upper tray 102 by the discharging apparatus 100. The discharge is into the lower tray 101 when a switch member 103 is retracted from the path of movement of the sheet by suitable switch means and is used when only a small number of copies is being made or when there is no need of sorting. The upper tray 102 is adapted to accommodate a large number (about 1000) of sheets, and is movable vertically by suitable drive means and discharge is into the upper tray when the switch member 103 is in the illustrated position.

When discharge is to be into the upper tray 102, the sheet P is turned upward along a belt 106 reeved around a belt supporting drive roller 105 and a belt supporting driven roller 104, and is passed under holding rollers 110 and 111 and further between a guide member 112 and a job offset roller 107 having the function of changing the direction of discharge of the paper, and discharged onto the tray 102 within a container 113 by discharge rollers 109.

Figure 2A:
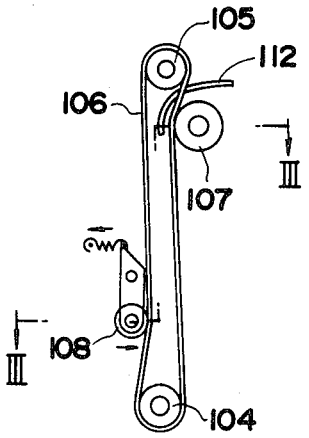
FIGS. 2(*a*) and (*b*) are fragmentary elevation views showing the paper discharging apparatus of the invention.
Figure 2B:
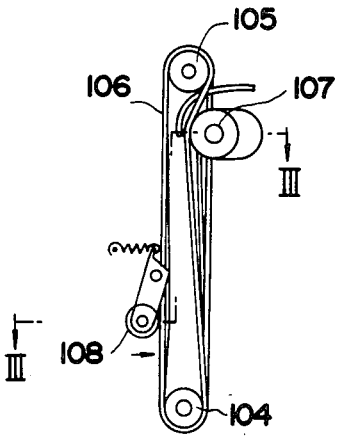
Figure 3A:
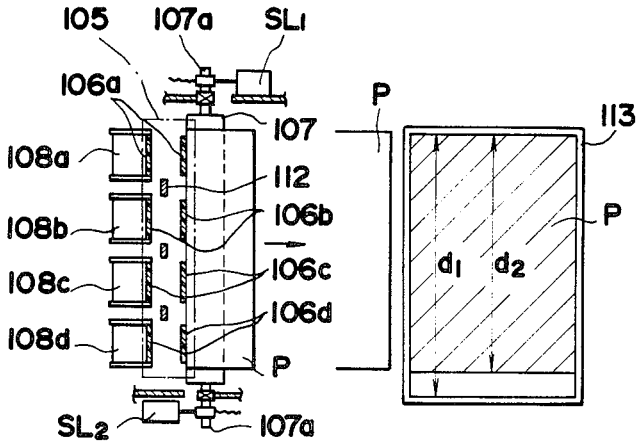
FIGS. 3(*a*) and (*b*) are plan views, partly in section, taken along the line III—III in FIGS. 2(*a*) and (*b*) respectively.
Figure 3B:
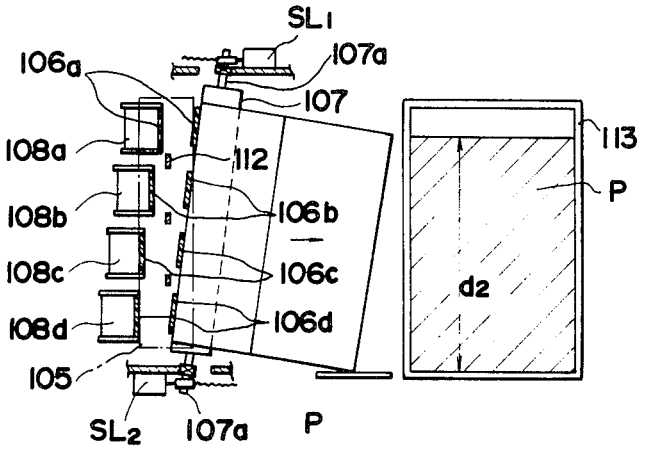

The discharge direction changing function will be described with reference to FIGS. 2(*a*) and 2(*b*) and FIGS. 3(*a*) and 3(*b*). FIGS. 2(*a*) and 2(*b*) show chiefly the relation between the belt 106 and the job offset roller 107 of the paper discharging apparatus 100 in FIG. 1. FIGS. 3(*a*) and 3(*b*) are views in section taken along the line III—III in FIGS. 2(*a*) and 2(*b*) respectively.

With the parts in the positions as shown in FIGS. 2(*a*) and 3(*a*), the job offset roller 107 is held parallel with the axis of the drive roller 105 and is in rolling contact with and driven by the belt 106 driven by the roller 105. The belt is comprised of parallel segments 106*a*, 106*b*, 106*c* and 106*d*. The sheet P is transported by the job offset roller 107 and the belt 106 in these positions and is turned through about 90° by the guide plate 112 and discharged into the container 113. The direction of discharge of the sheet P at this time is at a right angle to the axis of the roller 105 and will be referred to as the "straightforward direction".

When the job offset roller 107 has its rotary shaft 107*a* inclined by solenoids SL1 and SL2 or like roller shift means, as shown in FIGS. 2(*b*) and 3(*b*), the roller 107 is so displaced as to have the axis of rotation skew with respect to the roller 105 and to press against the belt 106 with a force which decreases from the belt segment 106*d* toward the belt segment 106*a*, twisting the belt 106 relative to the roller 105 at the belt portions in contact with the offset roller 107. The belt segments 106*a* to 106*d* are driven properly even in this state, with the tension thereon being suitably adjusted by tension rollers 108*a* to 108*d* for the respective belt segments.

When the sheet P is fed to the job offset roller 107 in contact with the belt segments 106*a* to 106*d*, the sheet P is forwarded along a plane perpendicular to the axis of the offset roller 107 and turned by the guide plate 112 through about 90° away from the belt 106 for further transport, whereby the direction of discharge of the sheet is changed from the straightforward direction to an offset direction which is at an angle to the straightforward direction corresponding to the inclination of the offset roller 107 as seen in FIG. 3(*b*).

Accordingly the discharge direction can be changed from the straightforward direction to the offset direction and vice versa by turning the solenoids SL1 and SL2 on and off by signals at predetermined timed intervals and thereby changing the axial direction of the offset roller 107 relative to the roller 105. The container 113 has a width d1 which is larger than the width d2 of the sheets being discharged, so that the processed sheets P are discharged onto the tray 102 at two positions. Thus the sheets can be sorted in a simple fashion by delivering a desired number of sheets to the two positions alternately.

Further, if the offset roller 107 is provided with means for inclining the axis of the roller in a direction opposite to the illustrated direction, the sheets can be discharged to any one of three positions on the tray 102.

While two solenoids are used in the foregoing embodiment for inclining the offset roller 107, other suitable shift means utilizing a cam or link mechanism can be used.

Figure 4A:
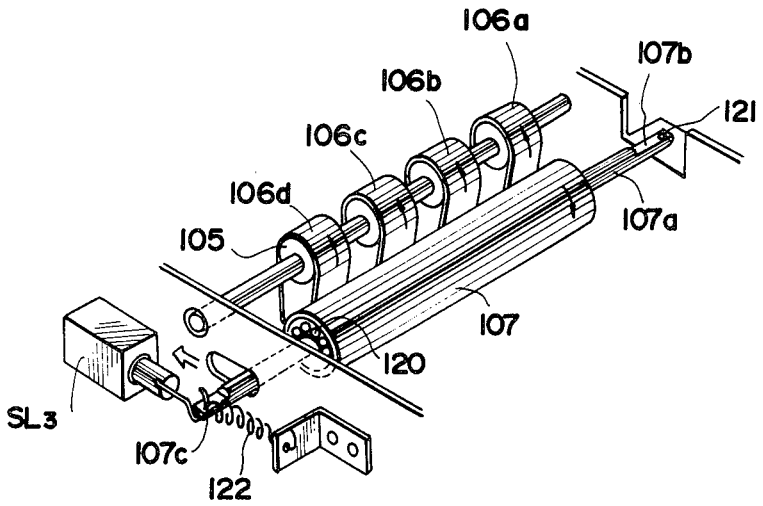
FIGS. 4(*a*), (*b*) and FIGS. 5(*a*), (*b*) are respective perspective and elevation views showing other mechanisms for inclining the axis of an offset roller.
Figure 4B:
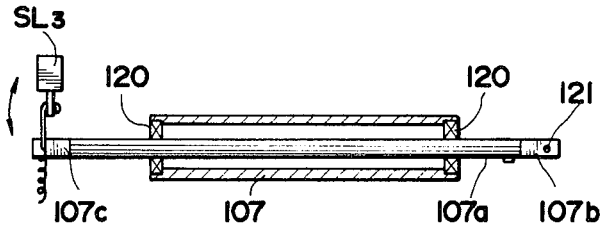
Figure 5A:
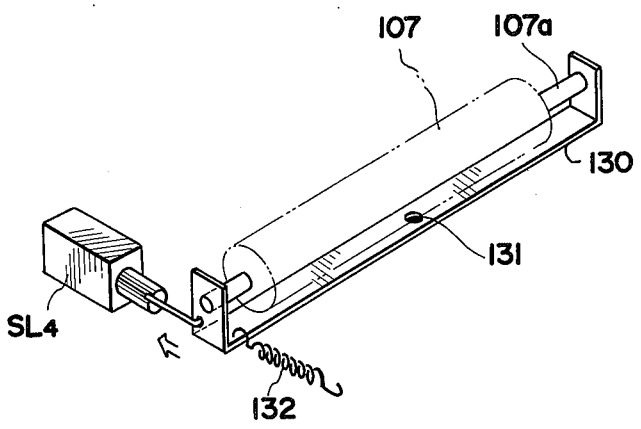
Figure 5B:
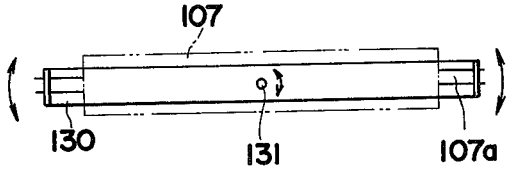

FIGS. 4(*a*) and 4(*b*) and FIGS. 5(*a*) and 5(*b*) show other mechanisms for inclining the axis of the offset roller 107.

With reference to FIGS. 4(*a*) and 4(*b*), the offset roller 107 is mounted on bearings 120 on a shaft 107*a* so as to be rotatable relative to the shaft 107*a*. The shaft 107*a* has one end 107*b* pivotably supported by a pin 121 on the frame of the apparatus and the other end 107*c* engaged with a spring 122 and a solenoid SL3. In the positions of the parts as shown in FIG. 4(*a*), wherein the solenoid SL3 is off, the shaft 107*a* is held in a stop position by the spring 122, in which position it discharges the paper sheet in the straightforward direction. The solenoid SL3, when energized, turns the shaft 107*a* clockwise about the pin 121, twisting the belt 106 with a force which increases toward the belt segment 106*d* so as to discharge the sheet at an angle to the straightforward direction.

In the embodiment shown in FIGS. 5(*a*) and 5(*b*), the offset roller 107 is supported at the opposite ends of the shaft 107*a* on a U-shaped support member 130 which in turn is rotatably supported by a pin 131 approximately at the center portion thereof. One end of the support member 130 is engaged with a spring 132 and a solenoid SL4. When the solenoid SL4 is energized, the offset roller 107 rotates as in FIGS. 3(*a*) and 3(*b*), pressing on the belt 106 with a force increasing from the segment 106*a* toward the segment 106*d* to change the direction of discharge of the paper. Although it is preferable that the belt 106 be composed of a plurality of divided portions like the segments 106*a* to 106*d* of the foregoing embodiment so as to be twisted by the offset roller 107 in rolling contact therewith, a belt in the form of a single integral piece of belt material can be used if it is sufficiently flexible.

When the copying machine 1 is used in combination with an automatic document feeder to obtain a plurality of copies of each of a plurality of documents, the feeder feeds a document when it it has been detected that the specified number of copies of the preceeding document have been made. In such a case, the signal or operation for the change of the document may be utilized for providing a signal or drive for the paper discharging apparatus 100 of this invention for changing the axial direction of the offset roller 107.

Thus the present invention provides an apparatus for discharging sheets of paper which comprises a belt for transporting the sheets, an offset roller in rolling contact with the belt, means for changing the axial direction of the offset roller to cause the belt to contact the offset roller in twisted relation to the axis of a belt guide or belt drive roller having the belt reeved therearound, and guide means for guiding the sheet of paper away from the belt at a position to the rear of the offset roller. Accordingly the apparatus changes the direction of discharge of the paper merely by displacing the offset roller, and thus avoids the hazard that would result from an operation in which the tray is moved, yet assures an easy sorting operation for processed sheets without making the overall size of the machine large. Moreover the apparatus of the invention avoids wrinkling or jamming which might occur if the sheet were laterally displaced within the machine relative to the direction of its advance.

What is claimed is:

1. An apparatus for discharging sheets of paper from a device for performing an operation on the sheets, said apparatus comprising:

a plurality of spaced parallel belt supporting rollers, one of said rollers being a drive roller;

a belt member reeved around said belt supporting rollers and having at least one run extending from a first to a second one of said belt supporting rollers, said belt member being positioned to receive sheets on the outer peripheral surface of said belt member at the end of said run adjacent said first belt supporting roller;

an offset roller in rolling contact with said outer peripheral surface of said belt member at a position downstream of said first belt supporting roller;

means connected to said offset roller for changing the position of the offset roller between a position in which the axis of rotation thereof is parallel to the axis of rotation of said first and second belt supporting rollers and a position in which the axis of rotation thereof is skew to the axis of rotation of said first and second belt supporting rollers for twisting said belt member as it passes said offset roller; and guide means just downstream of said offset roller for engaging and guiding sheets of paper carried along the outer peripheral surface of said belt member and betwen said belt member and said offset roller away from said belt member in a direction generally transverse to the axes of said belt supporting rollers.

2. An apparatus as claimed in claim 1 in which said offset roller has a shaft, one end of said shaft being pivotally mounted at a fixed position, and said position changing means is connected to the other end of said shaft for moving the other end of said shaft transversely of the length of said shaft.

3. An apparatus as claimed in claim 2 in which said position changing means comprises a solenoid connected to said other end of said shaft for moving said other end of said shaft in one direction and a spring connected to said other end of said shaft urging said other end of said shaft in a direction opposite the direction in which said other end of said shaft is moved by said solenoid.

4. An apparatus as claimed in claim 1 further comprising a U-shaped support member, said offset roller having a shaft rotatably mounted between the legs of said U-shaped support member, and said U-shaped support member being pivotally mounted along the bottom thereof for pivotal movement around an axis perpendicular to the axis of rotation of said offset roller, and said position changing means is connected to one end of said U-shaped support member for moving said one end of said U-shaped support around said axis of pivoting motion.

5. An apparatus as claimed in claim 4 in which said position changing means comprises a solenoid connected to said U-shaped support for moving said U-shaped support in one pivotal direction and a spring connected to said U-shaped support urging said U-shaped support in a direction opposite to the direction in which said U-shaped support is pivoted by said solenoid.

* * * * *